US006151722A

United States Patent [19]

Lubrano

[11] Patent Number: 6,151,722

[45] Date of Patent: Nov. 28, 2000

[54] TOILET CLEANER DISPENSING SYSTEM

[76] Inventor: John Lubrano, 8802 Bell Crest Ct., Tampa, Fla. 33634

[21] Appl. No.: 09/388,421

[22] Filed: Sep. 1, 1999

[51] Int. Cl.[7] ..... E03D 9/00

[52] U.S. Cl. ..... 4/225.1; 4/227.1

[58] Field of Search ..... 4/225.1, 223, 226.1, 4/227.1, 231

[56] References Cited

U.S. PATENT DOCUMENTS

| | | | |
|---|---|---|---|
| 3,023,427 | 3/1962 | Behringer | 4/225.1 |
| 3,135,969 | 6/1964 | Nolen | 4/225.1 |
| 3,482,269 | 12/1969 | Tietema et al. | 4/225 |
| 4,429,423 | 2/1984 | Syrenne | 4/225.1 |
| 4,841,578 | 6/1989 | Mercer | 4/225.1 X |
| 4,937,892 | 7/1990 | Syrenne | 4/226 |
| 5,347,661 | 9/1994 | Fly et al. | 4/225.1 |
| 5,404,594 | 4/1995 | Ring et al. | 4/224 |
| 5,581,823 | 12/1996 | Kuo | 4/226.1 |
| 5,611,465 | 3/1997 | Lee et al. | 222/214 |
| 5,673,439 | 10/1997 | Kuo | 4/222 |

FOREIGN PATENT DOCUMENTS

| | | | |
|---|---|---|---|
| 0466414 | 5/1937 | United Kingdom | 4/226.1 |

*Primary Examiner*—Charles E. Phillips
*Attorney, Agent, or Firm*—Joseph N. Breaux

[57] ABSTRACT

A toilet cleaner dispensing system for use with toilet cleaner tablets that dispenses toilet cleaner into the toilet bowl through the tank overflow tube so that the water within the toilet tank does not contain high concentrations of toilet cleaning. The toilet cleaner dispensing system includes a lower tablet housing structure, a top housing member, a tube clip, and a resilient sealing ring, 34.

1 Claim, 3 Drawing Sheets

TOILET CLEANER DISPENSING SYSTEM

TECHNICAL FIELD

The present invention relates to toilet cleaner dispensing mechanisms and devices and more particularly to a toilet cleaner dispensing system that dispenses toilet cleaner directly into the toilet tank overflow tube and not into the toilet tank to prevent damage to the rubber and plastic elements within the toilet tank from toilet cleaner remaining within the toilet tank for long periods, the toilet bowl cleaning system including a lower tablet housing structure having a bottom sealing ring compression ledge formed around the top circumferential edge of the lower tablet housing, an internally threaded tablet insertion opening defined by the sealing ring compression ledge and in connection with a tablet storage cavity formed within lower tablet housing structure, a dispenser input tube attachment fixture having a fluid passageway through the end thereof and in connection with the tablet storage cavity, and a dispenser output tube attachment fixture having a fluid passageway through the end thereof and in connection with the tablet storage cavity; a top housing member having an externally threaded bottom portion companionately threaded to engage the internal threading of the tablet insertion opening, a top sealing ring compression ledge having the same shape and dimensions as the bottom sealing ring compression ledge, an L-shaped overflow tube clip attachment structure extending from a side edge of the top housing member; a tube clip including a C-shaped clip attachment structure engagement end sized to engageably connect to the L-shaped overflow tube clip attachment structure integrally formed with a split semi-circular tube clip having two outwardly flared ends defining a tube insertion opening; and a resilient sealing ring having an internal opening positioned around the bottom portion of the top housing member; the resilient sealing ring being compressed to form a seal between the top and bottom sealing ring compression ledges when the bottom portion of the top housing member is fully threaded into the internally threaded tablet insertion opening of the lower tablet housing structure.

BACKGROUND ART

Toilet bowls can rapidly become soiled and stained. It is beneficial, therefore, to have cleaner dispensers for dispensing quantities of toilet bowl cleaner into the toilet tank and to then dispense the water from the toilet tank into the toilet bowl by flushing to maintain the toilet bowl in a clean disinfected condition. Although the toilet bowl cleaner maintains the bowl in the desired condition, the concentrations of toilet bowl cleaner stored within the toilet tank can damage and reduce the service life of resilient plastic or rubber components such as the flush valve. It would be a benefit, therefore, to have a toilet cleaner dispensing system that dispensed toilet cleaner into the toilet bowl through the tank overflow tube so that the water within the toilet tank does not contain high concentrations of toilet cleaning.

GENERAL SUMMARY DISCUSSION OF INVENTION

It is thus an object of the invention to provide a toilet cleaner dispensing system that includes a lower tablet housing structure having a bottom sealing ring compression ledge formed around the top circumferential edge of the lower tablet housing, an internally threaded tablet insertion opening defined by the sealing ring compression ledge and in connection with a tablet storage cavity formed within lower tablet housing structure, a dispenser input tube attachment fixture having a fluid passageway through the end thereof and in connection with the tablet storage cavity, and a dispenser output tube attachment fixture having a fluid passageway through the end thereof and in connection with the tablet storage cavity; a top housing member having an externally threaded bottom portion companionately threaded to engage the internal threading of the tablet insertion opening, a top sealing ring compression ledge having the same shape and dimensions as the bottom sealing ring compression ledge, an L-shaped overflow tube clip attachment structure extending from a side edge of the top housing member; a tube clip including a C-shaped clip attachment structure engagement end sized to engageably connect to the L-shaped overflow tube clip attachment structure integrally formed with a split semi-circular tube clip having two outwardly flared ends defining a tube insertion opening; and a resilient sealing ring having an internal opening positioned around the bottom portion of the top housing member; the resilient sealing ring being compressed to form a seal between the top and bottom sealing ring compression ledges when the bottom portion of the top housing member is fully threaded into the internally threaded tablet insertion opening of the lower tablet housing structure.

Accordingly, a toilet cleaner dispensing system is provided. The toilet cleaner dispensing system includes a lower tablet housing structure having a bottom sealing ring compression ledge formed around the top circumferential edge of the lower tablet housing, an internally threaded tablet insertion opening defined by the sealing ring compression ledge and in connection with a tablet storage cavity formed within lower tablet housing structure, a dispenser input tube attachment fixture having a fluid passageway through the end thereof and in connection with the tablet storage cavity, and a dispenser output tube attachment fixture having a fluid passageway through the end thereof and in connection with the tablet storage cavity; a top housing member having an externally threaded bottom portion companionately threaded to engage the internal threading of the tablet insertion opening, a top sealing ring compression ledge having the same shape and dimensions as the bottom sealing ring compression ledge, an L-shaped overflow tube clip attachment structure extending from a side edge of the top housing member; a tube clip including a C-shaped clip attachment structure engagement end sized to engageably connect to the L-shaped overflow tube clip attachment structure integrally formed with a split semi-circular tube clip having two outwardly flared ends defining a tube insertion opening; and a resilient sealing ring having an internal opening positioned around the bottom portion of the top housing member; the resilient sealing ring being compressed to form a seal between the top and bottom sealing ring compression ledges when the bottom portion of the top housing member is fully threaded into the internally threaded tablet insertion opening of the lower tablet housing structure.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
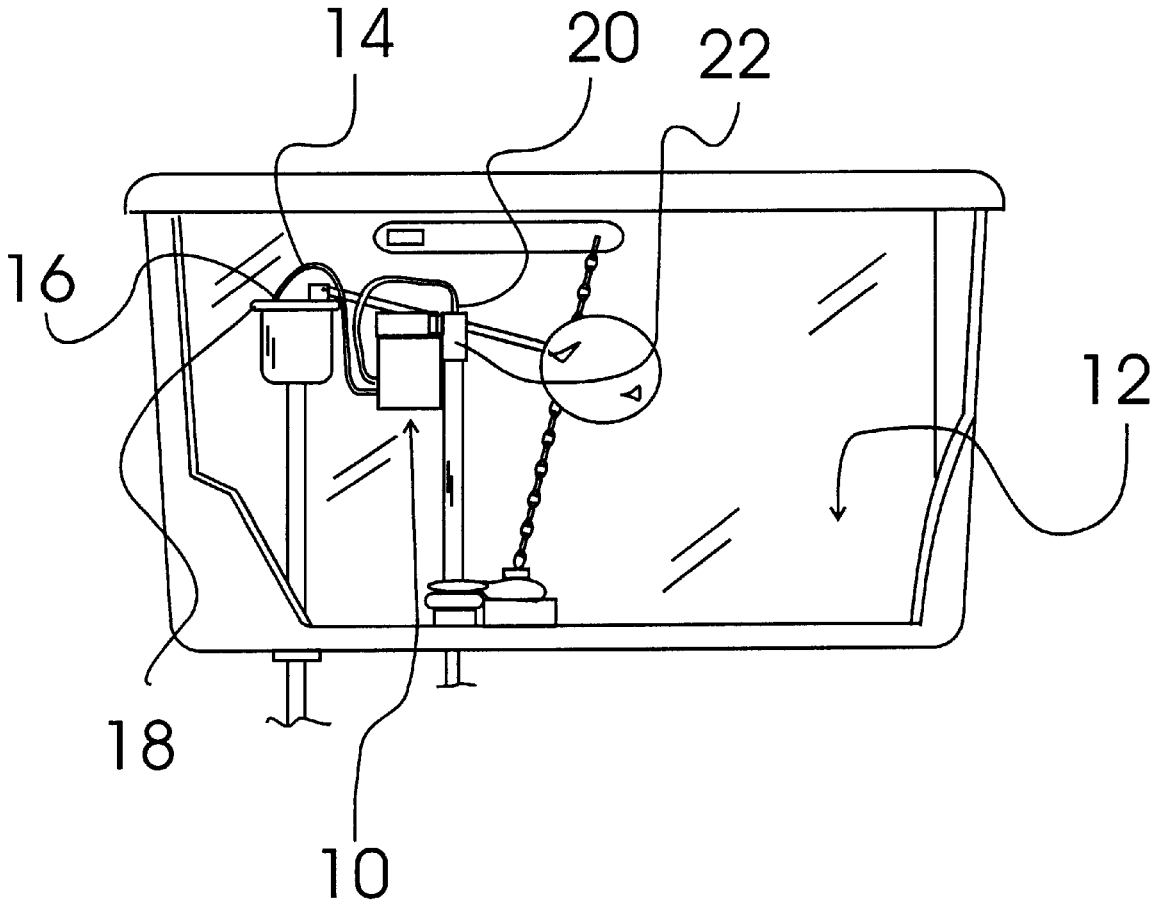
FIG. 1 is a partial cut-away perspective view showing an exemplary embodiment of the toilet cleaner dispensing system of the present invention installed within a representative toilet tank and having its dispenser input coupled to a flexible tube in connection with the over flow tube feed outlet of the float valve and the dispenser output coupled to a flexible tube in connection with the toilet tank over flow tube.

FIG. 1 shows an exemplary embodiment of the toilet cleaner dispensing system of the present invention, generally designated 10, installed within a representative toilet tank, generally designated 12, and having its dispenser input coupled to a flexible tube 14 in connection with an over flow tube feed outlet 16 of the float valve 18 and the dispenser output coupled to a flexible tube 20 in connection with a toilet tank over flow tube 22.

Figure 2:
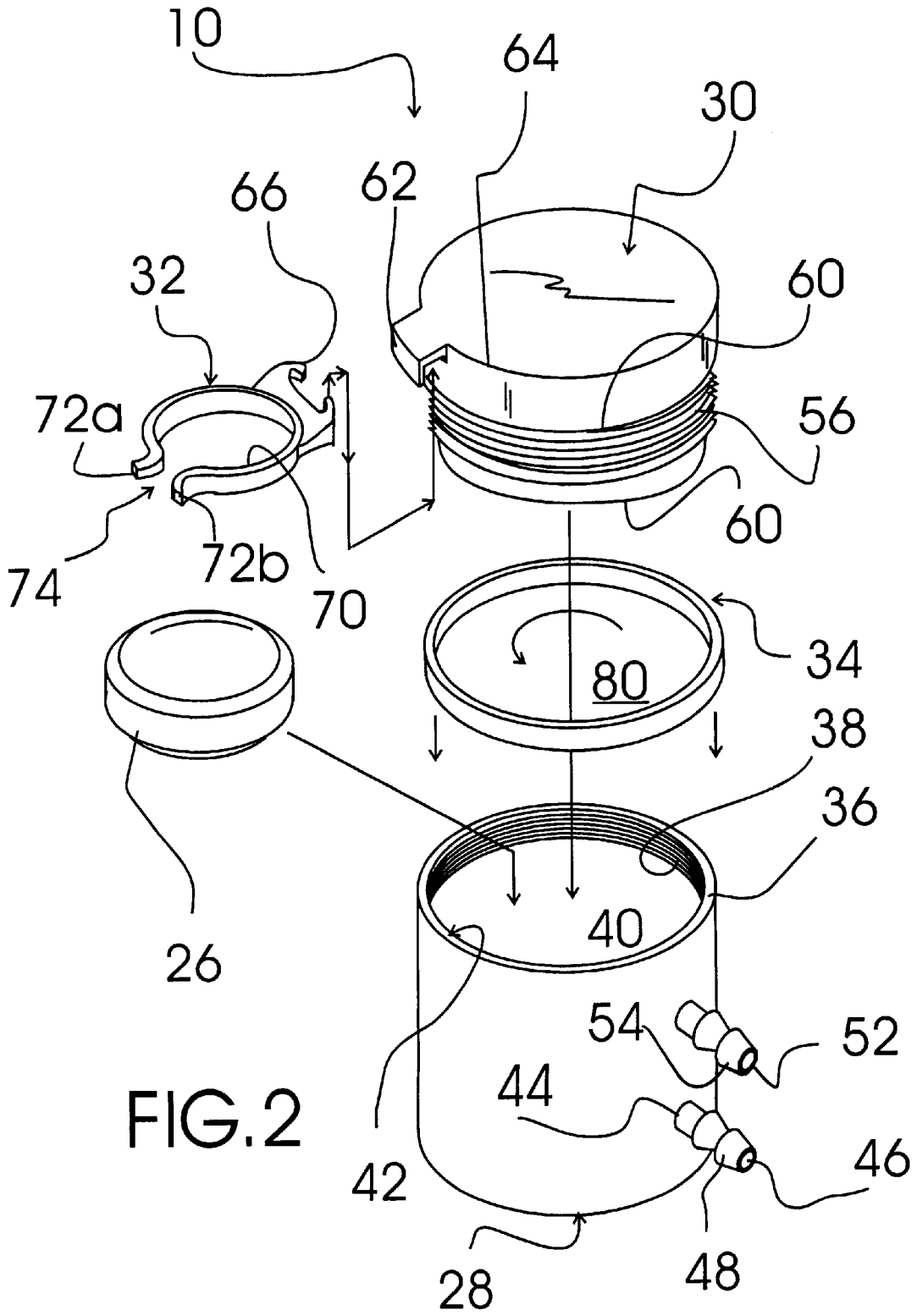
FIG. 2 is an exploded perspective view of an exemplary embodiment of the toilet cleaner dispensing system and a representative toilet cleaner tablet to be housed within the toilet cleaner dispensing system; the toilet bowl cleaning system including a lower tablet housing structure having a bottom sealing ring compression ledge formed around the top circumferential edge of the lower tablet housing, an internally threaded tablet insertion opening defined by the sealing ring compression ledge and in connection with a tablet storage cavity formed within lower tablet housing structure, a dispenser input tube attachment fixture having a fluid passageway through the end thereof and in connection with the tablet storage cavity, and a dispenser output tube attachment fixture having a fluid passageway through the end thereof and in connection with the tablet storage cavity; a top housing member having an externally threaded bottom portion companionately threaded to engage the internal threading of the tablet insertion opening, a top sealing ring compression ledge having the same shape and dimensions as the bottom sealing ring compression ledge, an L-shaped overflow tube clip attachment structure extending from a side edge of the top housing member; a tube clip including a C-shaped clip attachment structure engagement end sized to engageably connect to the L-shaped overflow tube clip attachment structure integrally formed with a split semi-circular tube clip having two outwardly flared ends defining a tube insertion opening; and a resilient sealing ring having an internal opening positioned around the bottom portion of the top housing member; the resilient sealing ring being compressed to form a seal between the top and bottom sealing ring compression ledges when the bottom portion of the top housing member is fully threaded into the internally threaded tablet insertion opening of the lower tablet housing structure.

Referring to FIG. 2, toilet cleaner dispensing system 10 is used with toilet cleaner tablets 26 formed of compressed toilet cleaning agents such as dry chlorine which are housed within the toilet cleaner dispensing system 10. Toilet bowl cleaning system 10 includes a lower tablet housing structure, generally designated 28; a top housing member, generally designated 30; a tube clip, generally designated 32; and a resilient sealing ring, generally designated 34.

Lower tablet housing structure 28 is of molded plastic construction and has a bottom sealing ring compression ledge 36 formed around the top circumferential edge of lower tablet housing structure 28, an internally threaded 38 tablet insertion opening 40 defined by sealing ring compression ledge 36 and in connection with a cylinder shaped tablet storage cavity 42 formed within lower tablet housing structure 28, a dispenser input tube attachment fixture 44 having a fluid passageway 46 formed through the end 48 thereof and in connection with tablet storage cavity 42, and a dispenser output tube attachment fixture 50 having a fluid passageway 52 through the end 54 thereof and in connection with tablet storage cavity 42.

Top housing member 30 is of molded plastic construction and includes an externally threaded 56 bottom portion 60 that is companionately threaded to engage internal threading 38 of tablet insertion opening 40, a top sealing ring compression ledge 60 having the same shape and dimensions as bottom sealing ring compression ledge 36, an L-shaped overflow tube clip attachment structure 62 extending from a side edge 64 of top housing member 30.

Tube clip 32 includes a C-shaped clip attachment structure engagement end 66 sized to engageably connect to L-shaped overflow tube clip attachment structure 62 and integrally formed with a split semi-circular tube clip 70 having two outwardly flared ends 72*a*,72*b* defining a tube insertion opening 74 therebetween.

Figure 3:
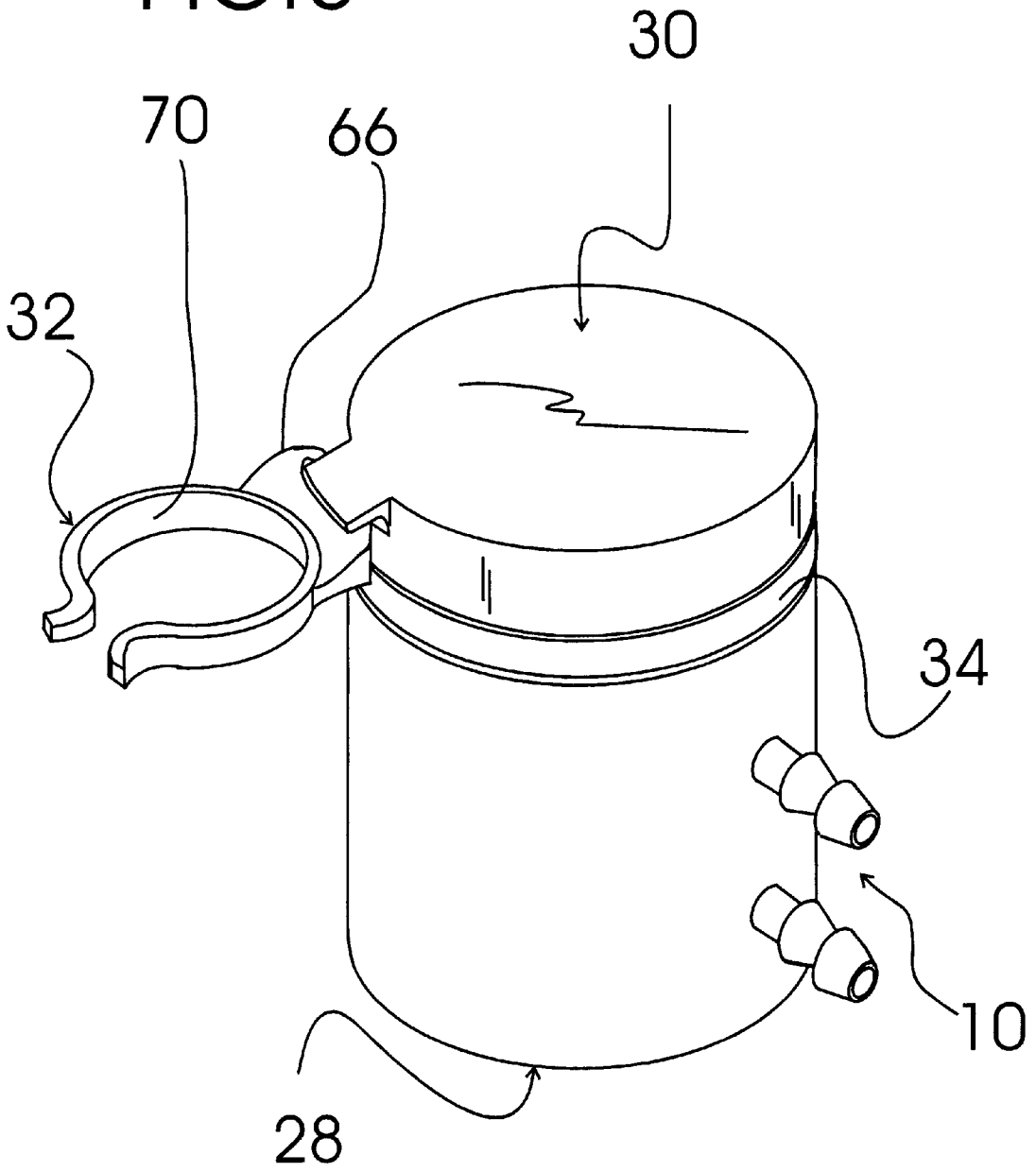
FIG. 3 is a perspective view of the toilet cleaner dispensing system of FIG. 2 showing the top housing member threaded into the lower tablet housing structure, the resilient sealing ring compressed between the bottom and top sealing ring compression ledges, and the C-shaped clip attachment structure engagement end of the tube clip in engagement with the L-shaped overflow tube clip attachment structure.

Resilient sealing ring 34 is a neoprene O-ring having an internal opening 80 positioned around and over bottom portion 60 of top housing member 30. Assembly of toilet cleaner dispenser system 10 is accomplished by, inserting toilet cleaner tablet 26 into tablet storage cavity 42, referring now to FIG. 3, positioning resilient sealing ring 34 over bottom portion 60 of top housing member 30 and compressed to form a seal between top and bottom sealing ring compression ledges 60,36 (FIG. 2) by fully threading bottom portion 60 (FIG. 2) of top housing member into internally threaded 38 (FIG. 2) tablet insertion opening 40 (FIG. 2) of lower tablet housing structure 28. Tube clip 32 is then attached to top housing member 30 by positioning C-shaped clip attachment structure engagement end 66 around L-shaped overflow tube clip attachment structure 62. Split semi-circular tube clip 70 is then snap fit onto the tank overflow tube 22 (FIG. 1) to hold toilet cleaner dispensing system 10 in position within tank 12 (FIG. 1).

It can be seen from the preceding description that a toilet cleaner dispensing system has been provided that includes a lower tablet housing structure having a bottom sealing ring compression ledge formed around the top circumferential edge of the lower tablet housing, an internally threaded tablet insertion opening defined by the sealing ring compression ledge and in connection with a tablet storage cavity formed within lower tablet housing structure, a dispenser input tube attachment fixture having a fluid passageway through the end thereof and in connection with the tablet storage cavity, and a dispenser output tube attachment fixture having a fluid passageway through the end thereof and in connection with the tablet storage cavity; a top housing member having an externally threaded bottom portion companionately threaded to engage the internal threading of the tablet insertion opening, a top sealing ring compression ledge having the same shape and dimensions as the bottom sealing ring compression ledge, an L-shaped overflow tube clip attachment structure extending from a side edge of the top housing member; a tube clip including a C-shaped clip attachment structure engagement end sized to engageably connect to the L-shaped overflow tube clip attachment structure integrally formed with a split semi-circular tube clip having two outwardly flared ends defining a tube insertion opening; and a resilient sealing ring having an internal opening positioned around the bottom portion of the top housing member; the resilient sealing ring being compressed to form a seal between the top and bottom sealing ring compression ledges when the bottom portion of the top housing member is fully threaded into the internally threaded tablet insertion opening of the lower tablet housing structure.

It is noted that the embodiment of the toilet cleaner dispensing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toilet cleaner dispensing system comprising:

a lower tablet housing structure having a bottom sealing ring compression ledge formed around a top circumferential edge of said lower tablet housing, an internally threaded tablet insertion opening defined by said sealing ring compression ledge and in connection with a tablet storage cavity formed within said lower tablet housing structure, a dispenser input tube attachment fixture having a fluid passageway through an end thereof and in connection with said tablet storage cavity, and a dispenser output tube attachment fixture having a fluid passageway through an end thereof and in connection with said tablet storage cavity;

a top housing member having an externally threaded bottom portion companionately threaded to engage said internal threading of said tablet insertion opening, a top sealing ring compression ledge having the same shape and dimensions as said bottom sealing ring compression ledge, an L-shaped overflow tube clip attachment structure extending from a side edge of said top housing member;

a tube clip including a C-shaped clip attachment structure engagement end sized to engageably connect to said L-shaped overflow tube clip attachment structure integrally formed with a split semi-circular tube clip having two outwardly flared ends defining a tube insertion opening; and a resilient sealing ring having an internal opening positioned around said bottom portion of said top housing member;

said resilient sealing ring being compressed to form a seal between said top and bottom sealing ring compression ledges when said bottom portion of said top housing member is fully threaded into said internally threaded tablet insertion opening of said lower tablet housing structure.

* * * * *